US011730283B2

(12) United States Patent
Yang

(10) Patent No.: US 11,730,283 B2
(45) Date of Patent: Aug. 22, 2023

(54) MULTIFUNCTIONAL FOLDABLE HIGHCHAIR

(71) Applicant: TJ(fujian) Industrial Co.,Ltd., Zhangzhou (CN)

(72) Inventor: Jianbo Yang, Zhangzhou (CN)

(73) Assignee: TJ (fujian) Industrial Co., Ltd., Zhangzhou (CN)

( * ) Notice: Subject to any disclaimer, the term of this patent is extended or adjusted under 35 U.S.C. 154(b) by 0 days.

(21) Appl. No.: 17/709,472

(22) Filed: Mar. 31, 2022

(65) Prior Publication Data

US 2022/0386785 A1 Dec. 8, 2022

(30) Foreign Application Priority Data

Jun. 3, 2021 (CN) ..... 202121230292.X

(51) Int. Cl.
*A47D 1/00* (2006.01)
*A47D 1/02* (2006.01)

(52) U.S. Cl.
CPC ..... *A47D 1/004* (2013.01); *A47D 1/008* (2013.01); *A47D 1/023* (2017.05)

(58) Field of Classification Search
None
See application file for complete search history.

(56) References Cited

U.S. PATENT DOCUMENTS 5,707,104 A * 1/1998 Perego ..... A47D 1/002 297/16.1
5,810,432 A * 9/1998 Haut ..... A47D 1/023 297/467
5,820,207 A * 10/1998 Wang ..... A47D 1/0083 297/148
6,161,898 A * 12/2000 Brevi ..... A47D 1/004 297/344.14
6,715,827 B1 * 4/2004 Chen ..... A47D 1/002 297/148
2003/0197408 A1 * 10/2003 Greger ..... A47D 1/002 297/354.12
2007/0029845 A1 2/2007 Riedl et al.
(Continued)

FOREIGN PATENT DOCUMENTS

CN 108013652 A * 5/2018
DE 10051261 A1 * 10/2001 ..... A47D 1/002

*Primary Examiner* — David E Allred
(74) *Attorney, Agent, or Firm* — Bayramoglu Law Offices LLC

(57) ABSTRACT

A multifunctional foldable highchair includes a front support frame and a rear support frame. The front support frame and the rear support frame are arranged in a foldable manner, and the front support frame and the rear support frame are both in a "U" shape. Two vertical parts of the front support frame are respectively provided with a left sleeve member and a right sleeve member. The left sleeve member and the right sleeve member are height-adjustable. Inner side surfaces of the left sleeve member and the right sleeve member are respectively provided with a detachable left armrest connecting rod and a detachable right armrest connecting rod. Top front ends of the left armrest connecting rod and the right armrest connecting rod are respectively provided with a left armrest and a right armrest. A dining tray is provided between the left armrest and the right armrest.

9 Claims, 14 Drawing Sheets

(56) References Cited

U.S. PATENT DOCUMENTS

| | | | | |
|---|---|---|---|---|
| 2008/0001459 | A1* | 1/2008 | Chen | A47D 1/002 297/377 |
| 2008/0179922 | A1 | 7/2008 | Troutman et al. | |
| 2008/0203779 | A1* | 8/2008 | Cheng | A47D 1/004 297/171 |
| 2014/0077534 | A1* | 3/2014 | Stolarz | A47D 1/0085 297/174 R |
| 2017/0127850 | A1* | 5/2017 | Sozzo | A47D 1/00 |
| 2019/0116989 | A1* | 4/2019 | Cheng | A47D 1/023 |
| 2020/0128970 | A1* | 4/2020 | Pujol | A47D 1/023 |
| 2021/0085094 | A1* | 3/2021 | Rosenthal | A47D 1/0081 |

* cited by examiner

MULTIFUNCTIONAL FOLDABLE HIGHCHAIR

CROSS REFERENCE TO THE RELATED APPLICATIONS

This application is based upon and claims priority to Chinese Patent Application No. 202121230292.X, filed on Jun. 3, 2021, the entire contents of which are incorporated herein by reference.

TECHNICAL FIELD

The present invention relates to the field of children's products, and more particularly, to a multifunctional foldable highchair.

BACKGROUND

Highchairs are special chairs for feeding children. Highchairs can help children develop the habit of sitting while eating and avoid the trouble of chasing a child for feeding. Children can sit steadily in a suitable highchair, and their hands can be freed to grasp tableware, which exercises the coordination of children's hands, eyes, and brain. With the development of technology, the types of highchairs, such as simple highchairs and foldable highchairs, are greatly expanded. The prior foldable highchairs can be folded as a whole, but their heights are not adjustable, thereby failing to meet the requirements of use at different heights.

SUMMARY

In order to overcome the above problem existing in the prior art, an objective of the present invention is to provide a multifunctional foldable highchair.

The present invention is implemented by the following technical solution:

A multifunctional foldable highchair includes a front support frame and a rear support frame, where the front support frame and the rear support frame are arranged in a foldable manner, and the front support frame and the rear support frame are both in a "U" shape; two vertical parts of the front support frame are respectively provided with a left sleeve member and a right sleeve member; the left sleeve member and the right sleeve member are height-adjustable; inner side surfaces of the left sleeve member and the right sleeve member are respectively provided with a detachable left armrest connecting rod and a detachable right armrest connecting rod; top front ends of the left armrest connecting rod and the right armrest connecting rod are respectively provided with a left armrest and a right armrest; a dining tray with a position adjustable from front to rear is provided between the left armrest and the right armrest; bottoms of the left armrest and the right armrest are respectively provided with a left strut and a right strut; tops of the left strut and the right strut are connected to the bottoms of the left armrest and the right armrest respectively; bottoms of the left strut and the right strut are hinged to the left sleeve member and the right sleeve member respectively; a seat is provided between a middle of the left strut and a middle of the right strut; a front end of the seat is provided with an angle-adjustable footrest; a rear end of the seat is provided with a backrest hinged there-to; and a rear end surface of the backrest is provided with a support rod detachably connected to the left armrest connecting rod and the right armrest connecting rod.

Further, each of the left sleeve member and the right sleeve member may be provided with a limiting groove with an open front end; a first insert may be provided in the limiting groove; a head may be provided at an inner end of the first insert, and a first insert portion may be provided at an outer end of the first insert; a height of the head portion may be greater than a height of the first insert; the head portion may be provided with a first upper inclined surface and a first lower inclined surface; each of front ends of the left sleeve member and the right sleeve member may be provided with a first button; a rear end of the first button may be provided with an upper pressing plate and a lower pressing plate; inner side surfaces of the upper pressing plate and the lower pressing plate may be respectively provided with a second upper inclined surface and a second lower inclined surface; the first insert may be located between the upper pressing plate and the lower pressing plate; the second upper inclined surface and the second lower inclined surface may be attached to the first upper inclined surface and the first lower inclined surface respectively; a first spring may be provided between an inner side surface of the head portion and an inner side wall of the corresponding left sleeve member and right sleeve member; each of inner side surfaces of the two vertical parts of the front support frame may be provided with a plurality of insertion holes spaced apart from top to bottom; and the first insert portion passes through the limiting groove to be inserted into a corresponding insertion hole.

Further, each of top left and right ends of the front support frame may be provided with a front pivoting piece, and each of top left and right ends of the rear support frame may be provided with a rear pivoting piece; the front pivoting piece may be correspondingly hinged to the rear pivoting piece to form a first movement space; an engaging member movable in left and right directions may be provided in the first movement space; the engaging member may be engaged with the front pivoting piece and the rear pivoting piece; and one side surface of the front pivoting piece may be provided with a second button for driving the engaging member to move.

Further, a plurality of engaging teeth may be provided on a periphery of the engaging member; the other side surface of the front pivoting piece may be provided with a first accommodating groove and a plurality of first engaging grooves distributed on a periphery of the first accommodating groove; the plurality of first engaging grooves communicate with the first accommodating groove; a side surface of the rear pivoting piece may be provided with a second accommodating groove and a plurality of second engaging grooves distributed on a periphery of the second accommodating groove; the plurality of second engaging grooves communicate with the second accommodating groove; the first accommodating groove and the second accommodating groove form the first movement space; the plurality of engaging teeth may be adapted to the plurality of first engaging grooves and the plurality of second engaging grooves; and in a use state, the plurality of engaging teeth are simultaneously engaged with the plurality of first engaging grooves and the plurality of second engaging grooves.

Further, an outer side surface of the front pivoting piece may be provided with a button groove adapted to the second button; the button groove may be provided with a plurality of first through grooves and a plurality of second through grooves communicating with the first accommodating groove; an inner side surface of the second button may be provided with a plurality of pressing pieces and a plurality of abutting rods; each pressing piece corresponds to one first through groove, and each abutting rod corresponds to one second through groove; a hook portion may be provided at one end of each pressing piece; each of the first through grooves may be provided with an abutting edge portion; each pressing piece passes through a corresponding first through groove, and the hook portion abuts against the abutting edge portion; each abutting rod passes through a corresponding second through groove; one end of each abutting rod abuts against the engaging member; and a second spring may be provided between the engaging member and the second accommodating groove.

Further, a left connecting member and a right connecting member may be provided at a bottom of the dining tray; outer side surfaces of the left connecting member and the right connecting member may be respectively provided with a left guide bar and a right guide bar; inner side surfaces of the left armrest and the right armrest may be respectively provided with a left guide groove and a right guide groove; the left guide bar and the right guide bar may be respectively located in the left guide groove and the right guide groove; a left accommodating groove and a right accommodating groove may be respectively provided in the left connecting member and the right connecting member; a left insert and a right insert may be respectively provided in the left accommodating groove and the right accommodating groove; a pull plate may be provided at the bottom of the dining tray; the pull plate may be provided with a left pull bar and a right pull bar; one end of the left pull bar passes through the left connecting member to be connected to one end of the left insert, and one end of the right pull bar passes through the right connecting member to be connected to one end of the right insert; the other end of the left insert and the other end of the right insert may be respectively provided with a left insert portion and a right insert portion; a plurality of left insertion ports and a plurality of right insertion ports may be respectively provided in the left guide groove and the right guide groove; the plurality of left insertion ports may be spaced apart from front to rear, and the plurality of right insertion ports may be spaced apart from front to rear; the left insert portion and the right insert portion may be respectively inserted into a corresponding left insertion port and a corresponding right insertion port; a left pull bar groove and a right pull bar groove may be provided at the bottom of the dining tray; the left pull bar and the right pull bar may be respectively located in the left pull bar groove and the right pull bar groove; and bottoms of the left pull bar groove and the right pull bar groove may be respectively provided with a left support plate configured to support the left pull bar and a right support plate configured to support the right pull bar.

Further, a rear top surface of the pull plate may be provided with a first spring groove; a third spring may be provided in the first spring groove; a front bottom surface of the first spring groove may be provided with a first elongated groove; the bottom of the dining tray may be provided with a locking post; a bottom of the pull plate may be provided with a hand accommodating groove; the bottom of the dining tray may be provided with a bottom plate; the bottom plate may be provided with a hand accommodating chamber with an open top surface; the hand accommodating chamber may be opposite to the hand accommodating groove; the locking post passes through the first elongated groove to be locked to the bottom plate; and the third spring may be located between the locking post and a rear inner side wall of the first spring groove.

Further, the inner side surfaces of the left sleeve member and the right sleeve member may be respectively provided with a left sleeve connecting portion and a right sleeve connecting portion; tops of the left sleeve connecting portion and the right sleeve connecting portion may be respectively provided with a left insertion groove and a right insertion groove; the left sleeve connecting portion and the right sleeve connecting portion may be respectively provided with a left sleeve and a right sleeve; the left sleeve and the right sleeve may be respectively provided with a second insert portion inserted into the left insertion groove and a third insert portion inserted into the right insertion groove; each of top rear ends of the left sleeve and the right sleeve may be provided with a pull portion; and lower parts of the left armrest connecting rod and the right armrest connecting rod may be respectively nested in and connected to the left sleeve and the right sleeve.

Further, an upper rear end surface of the backrest may be provided with a second spring groove and two second elongated grooves; the second spring groove may be located between the two second elongated grooves; a fourth spring may be provided in the second spring groove; a lifting member may be provided on an upper rear end portion of the backrest; a front end of the lifting member may be open; a spring abutting portion and two limiting rods may be provided in the lifting member; a bottom of the fourth spring abuts against the spring abutting portion; the two limiting rods respectively pass through the corresponding second elongated grooves and are movably connected from top to bottom to the backrest by screws; a front upper portion of the lifting member may be provided with rod grooves; the support rod may have an inverted "U" shape; a middle of the support rod may be located in the rod grooves; each of top surfaces of the left armrest connecting rod and the right armrest connecting rod may be provided with a sliding groove; two rod holes may be arranged from front to rear in the sliding groove; and two bottom ends of the support rod may be respectively inserted into the rod holes of the left armrest connecting rod and the right armrest connecting rod.

According to the description of the present invention, compared with the prior art, the present invention has the following advantages. The present invention has a novel structure and clever design. The left sleeve member and the right sleeve member are adjustable in height. After the heights of the left sleeve member and the right sleeve member are adjusted, the heights of the left armrest connecting rod, the right armrest connecting rod, the left armrest, the right armrest, the dining tray, the seat and the backrest can be adjusted synchronously to meet the requirements of the use of the highchair at different heights. The front support frame and the rear support frame are arranged in a foldable manner. When the left armrest connecting rod and the right armrest connecting rod are detached from the left sleeve member and the right sleeve member respectively, the left strut and the right strut are rotatable. Thus, the left armrest connecting rod, the right armrest connecting rod, the left armrest, the right armrest, the dining tray, the seat and the backrest can be rotated synchronously for folding. Meanwhile, when the support rod is detached from the left armrest connecting rod and the right armrest connecting rod, the backrest can be further folded. The highchair of the present invention is foldable and height-adjustable, which diversifies the functions of the highchair.

DETAILED DESCRIPTION OF THE EMBODIMENTS

Figure 1:
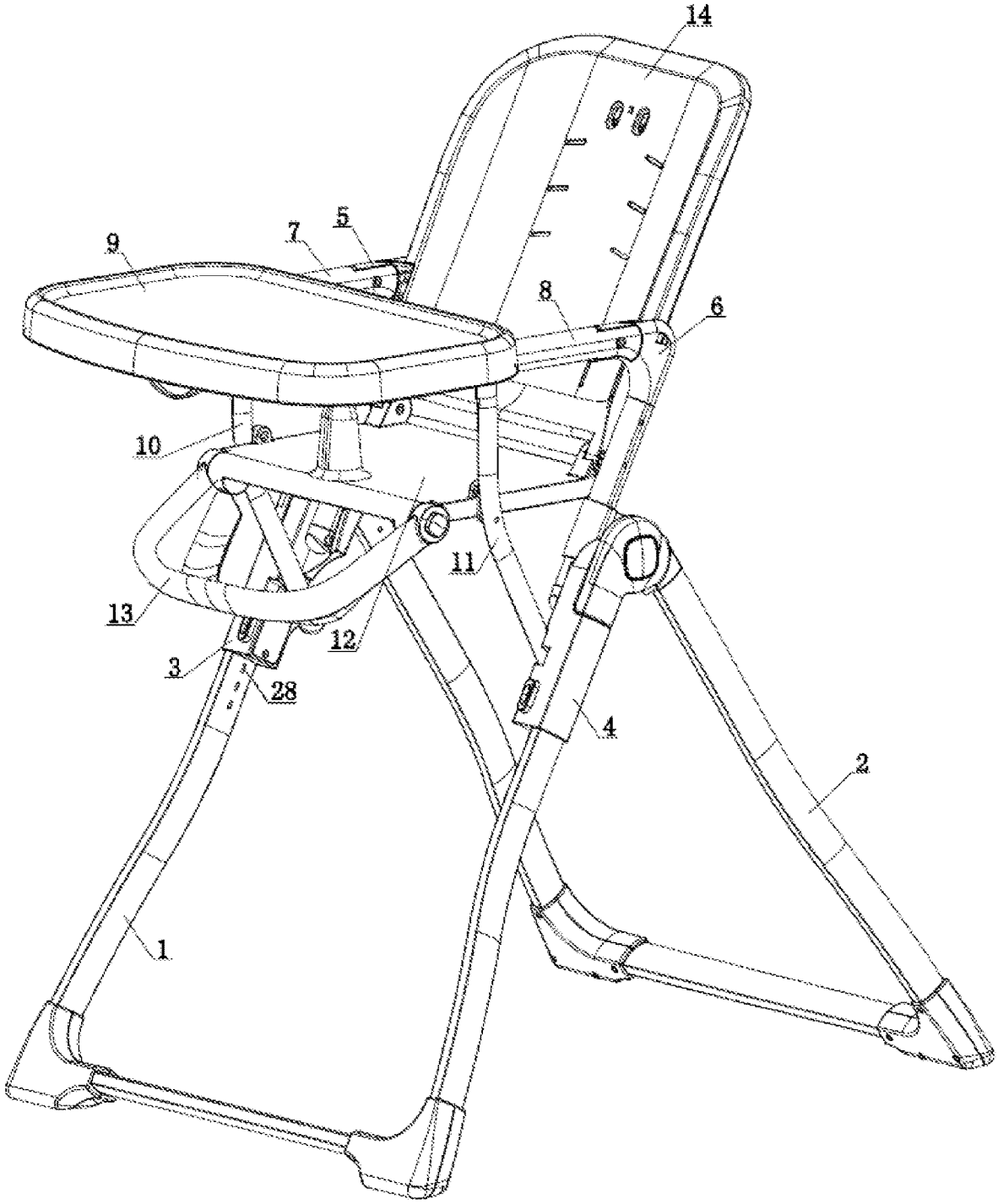
FIG. 1 is a structural view of a multifunctional foldable highchair according to the present invention.
Figure 11:
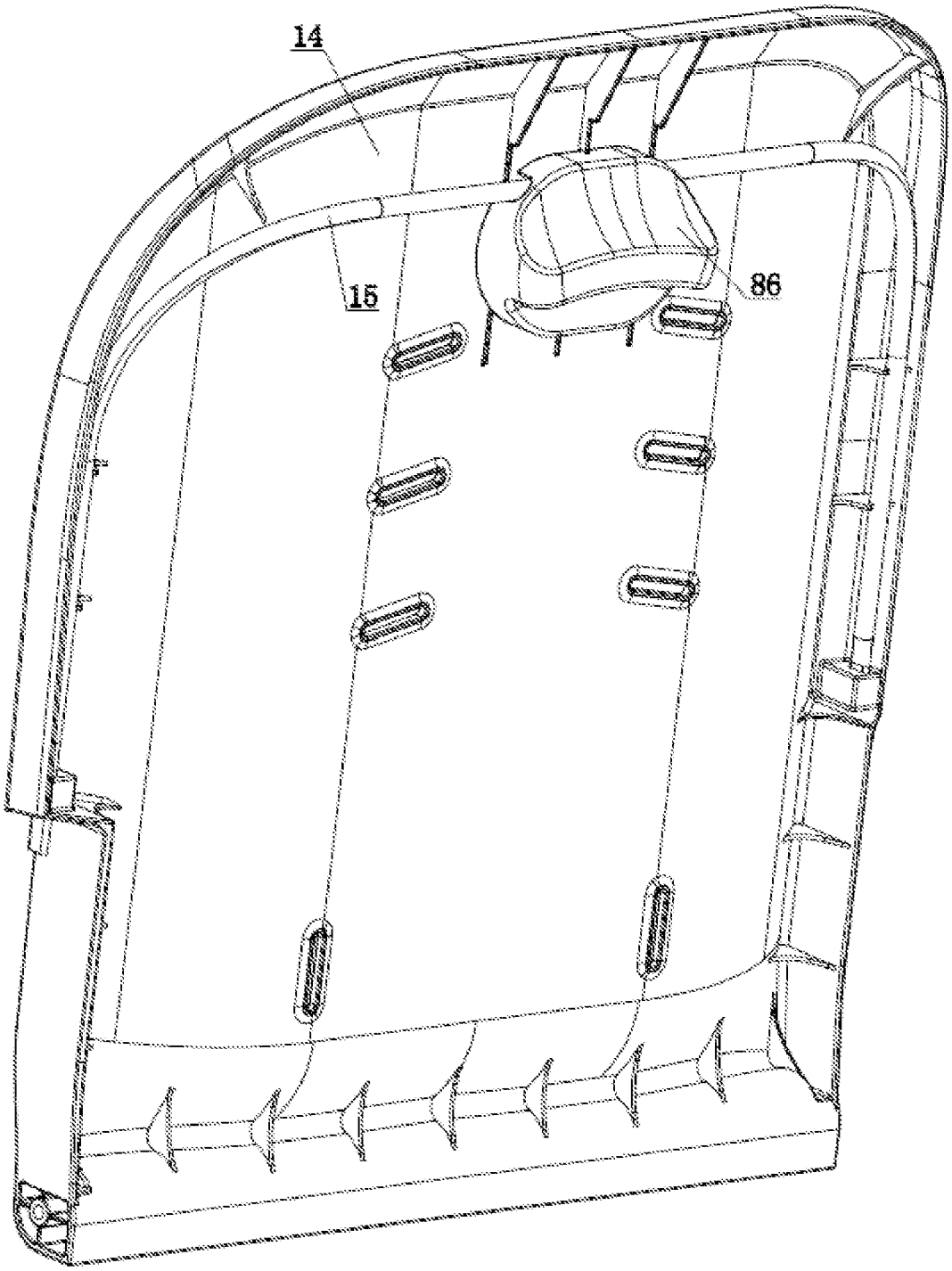
FIG. 11 is a structural view of the backrest according to the present invention.
Figure 12:
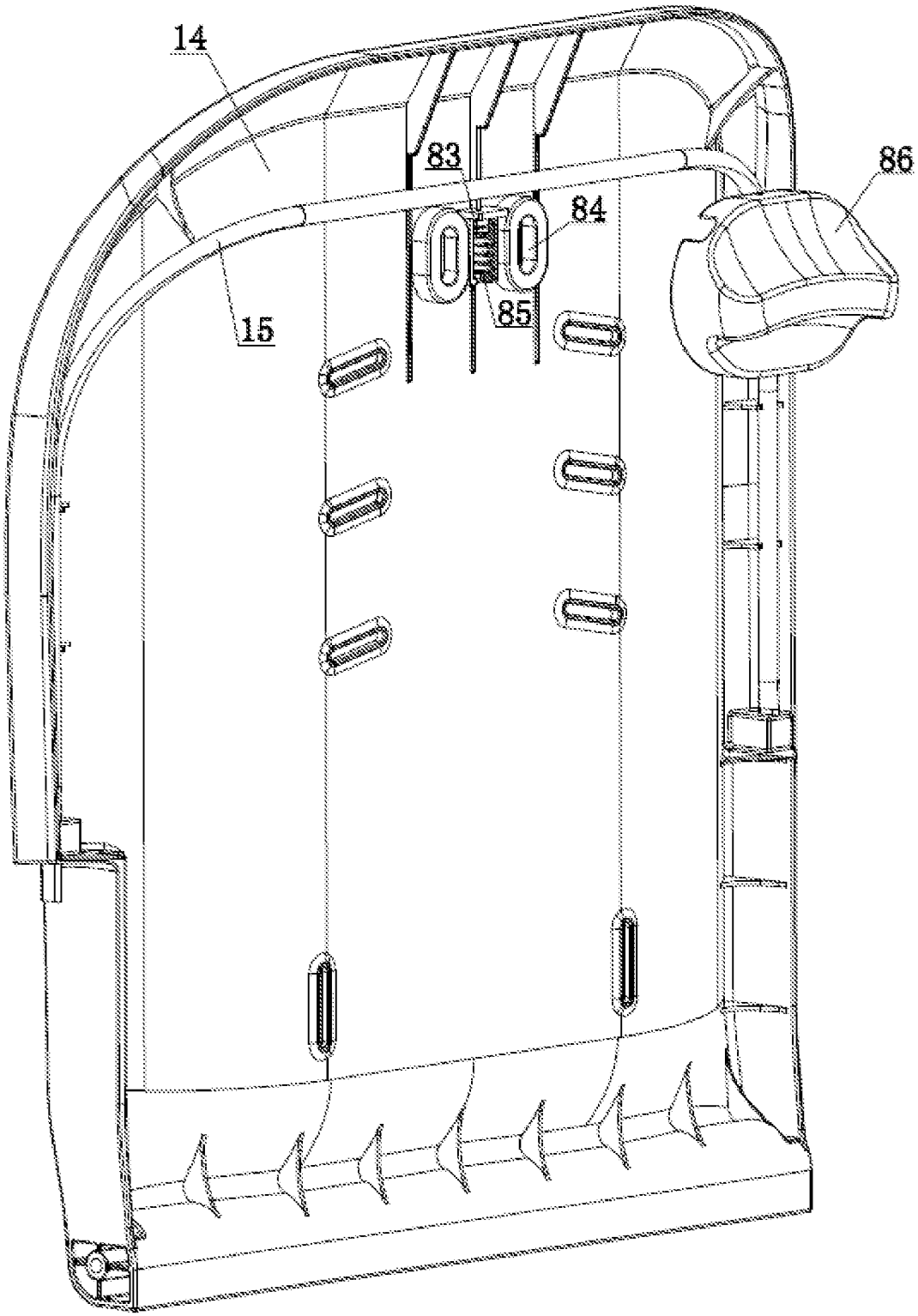
FIG. 12 is another structural view of the backrest according to the present invention.
Figure 13:
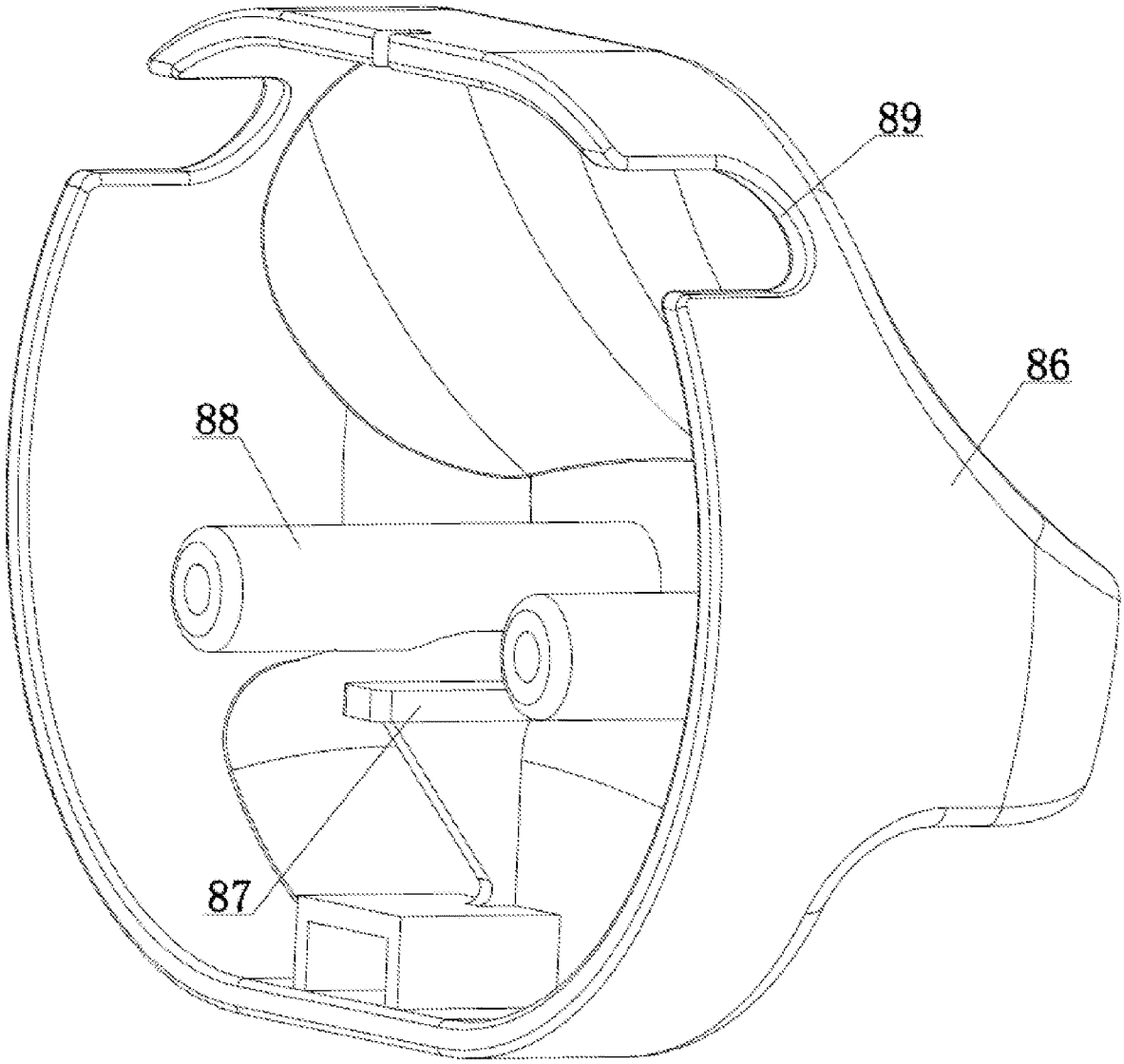
FIG. 13 is a structural view of a lifting member according to the present invention.

Referring to FIGS. 1 and 11, a multifunctional foldable highchair includes a front support frame 1 and a rear support frame 2. The front support frame 1 and the rear support frame 2 are arranged in a foldable manner, and the front support frame 1 and the rear support frame 2 are both in a "U" shape. Two vertical parts of the front support frame 1 are respectively provided with a left sleeve member 3 and a right sleeve member 4. The left sleeve member 3 and the right sleeve member 4 are height-adjustable. Inner side surfaces of the left sleeve member 3 and the right sleeve member 4 are respectively provided with a detachable left armrest connecting rod 5 and a detachable right armrest connecting rod 6. Top front ends of the left armrest connecting rod 5 and the right armrest connecting rod 6 are respectively provided with a left armrest 7 and a right armrest 8. A dining tray 9 with a position adjustable from front to rear is provided between the left armrest 7 and the right armrest 8. Bottoms of the left armrest 7 and the right armrest 8 are respectively provided with a left strut 10 and a right strut 11. Tops of the left strut 10 and the right strut 11 are connected to the bottoms of the left armrest 7 and the right armrest 8 respectively. Bottoms of the left strut 10 and the right strut 11 are hinged to the left sleeve member 3 and the right sleeve member 4 respectively. A seat 12 is provided between a middle of the left strut 10 and a middle of the right strut 11. A front end of the seat 12 is provided with an angle-adjustable footrest 13. A rear end of the seat 12 is provided with a backrest 14 hinged there-to. A rear end surface of the backrest 14 is provided with a support rod 15 detachably connected to the left armrest connecting rod 5 and the right armrest connecting rod 6.

Figure 2:
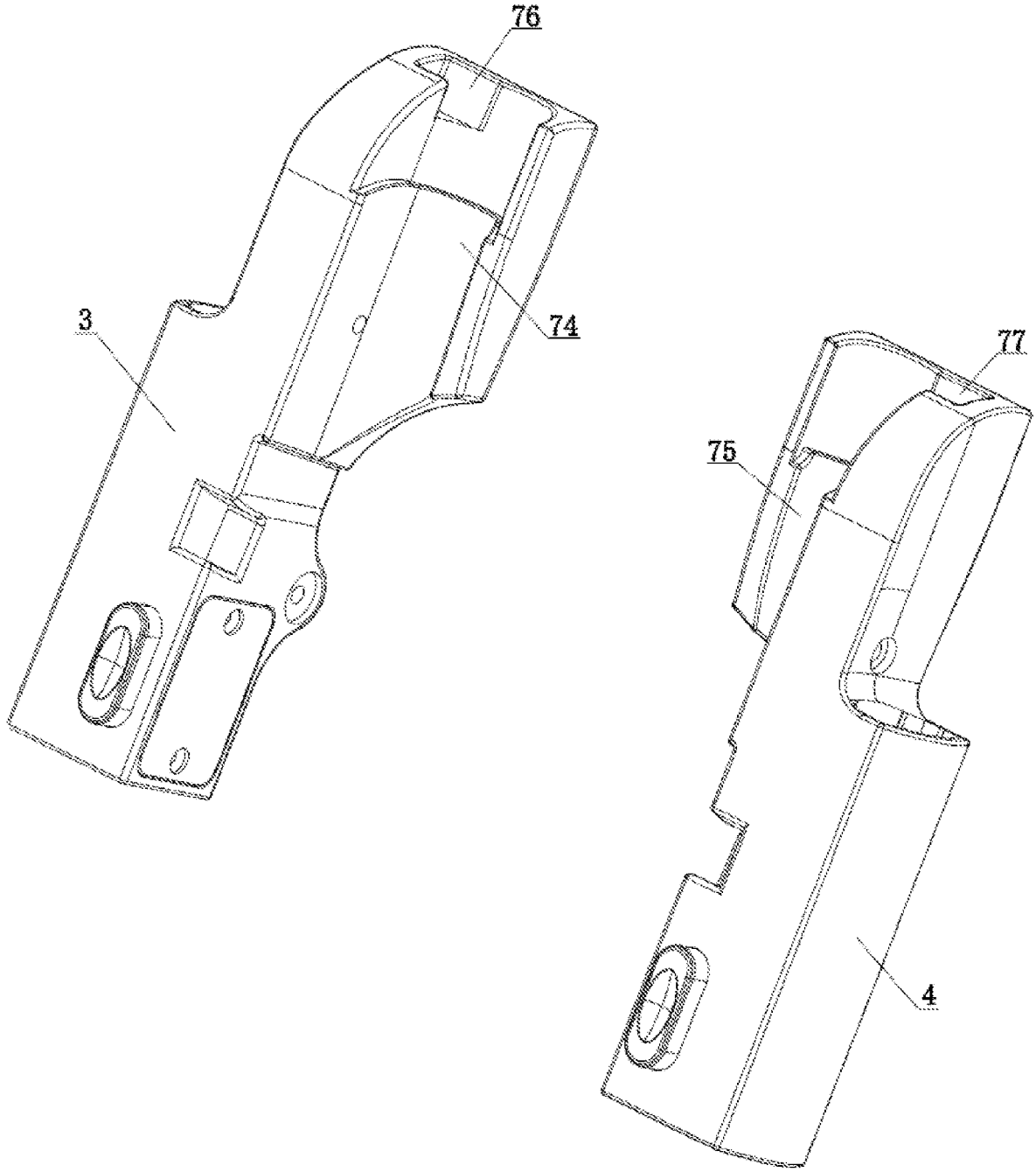
FIG. 2 is a structural view of a left sleeve member and a right sleeve member according to the present invention.
Figure 3:
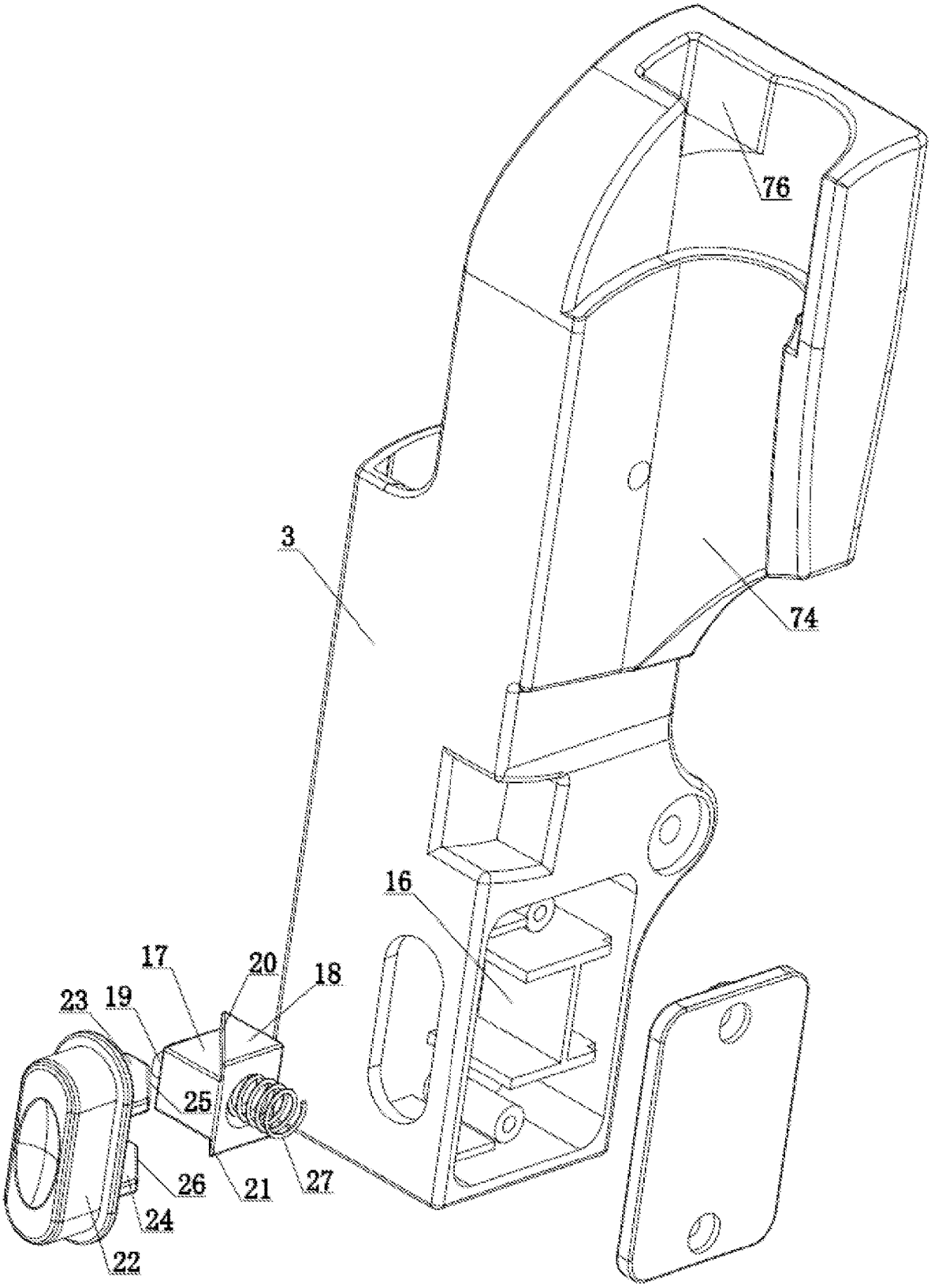
FIG. 3 is an exploded view of the left sleeve member according to the present invention.
Figure 4:
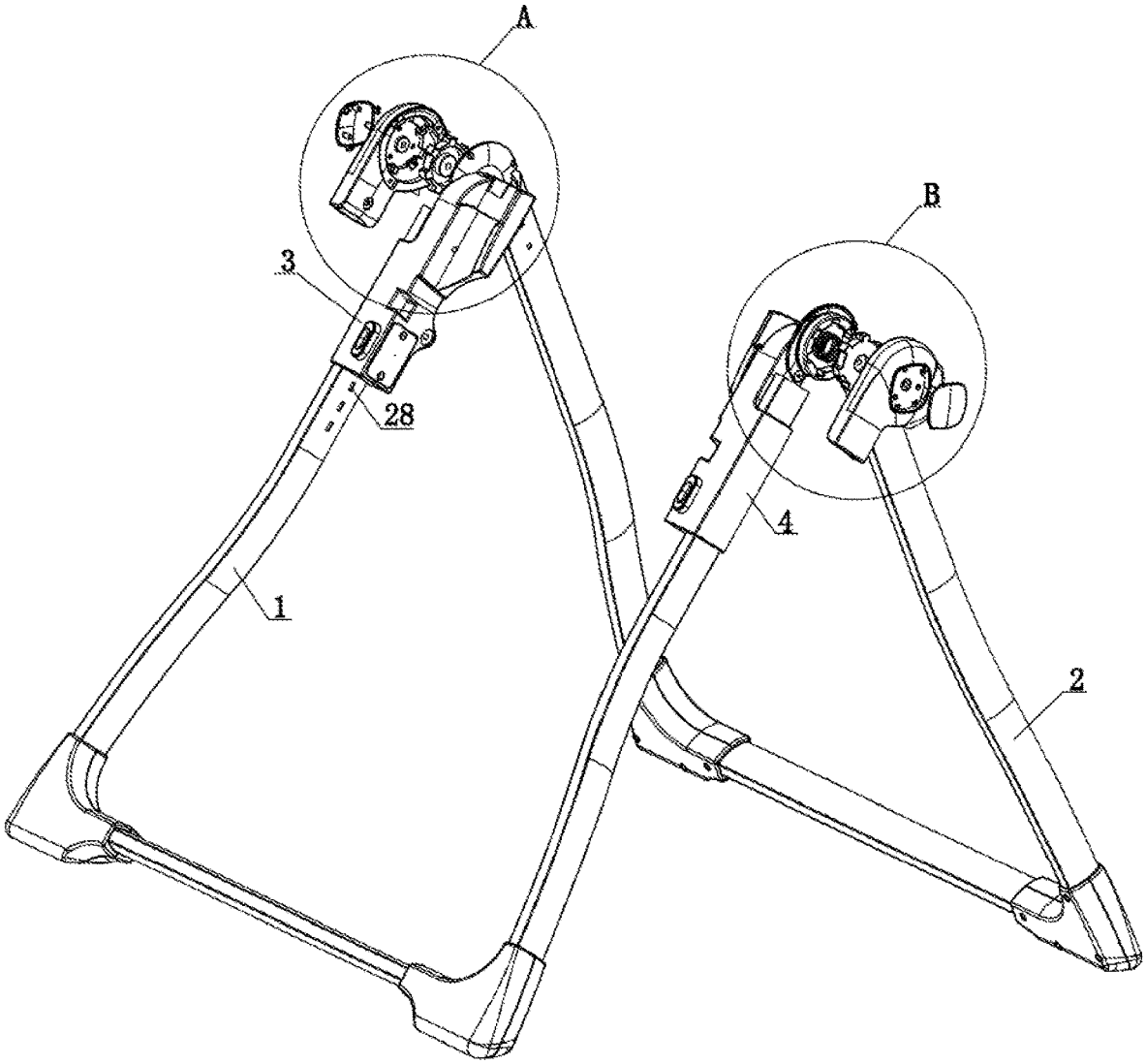
FIG. 4 is a partial view of the multifunctional foldable highchair excluding a dining tray, a seat and a backrest.
Figure 5:
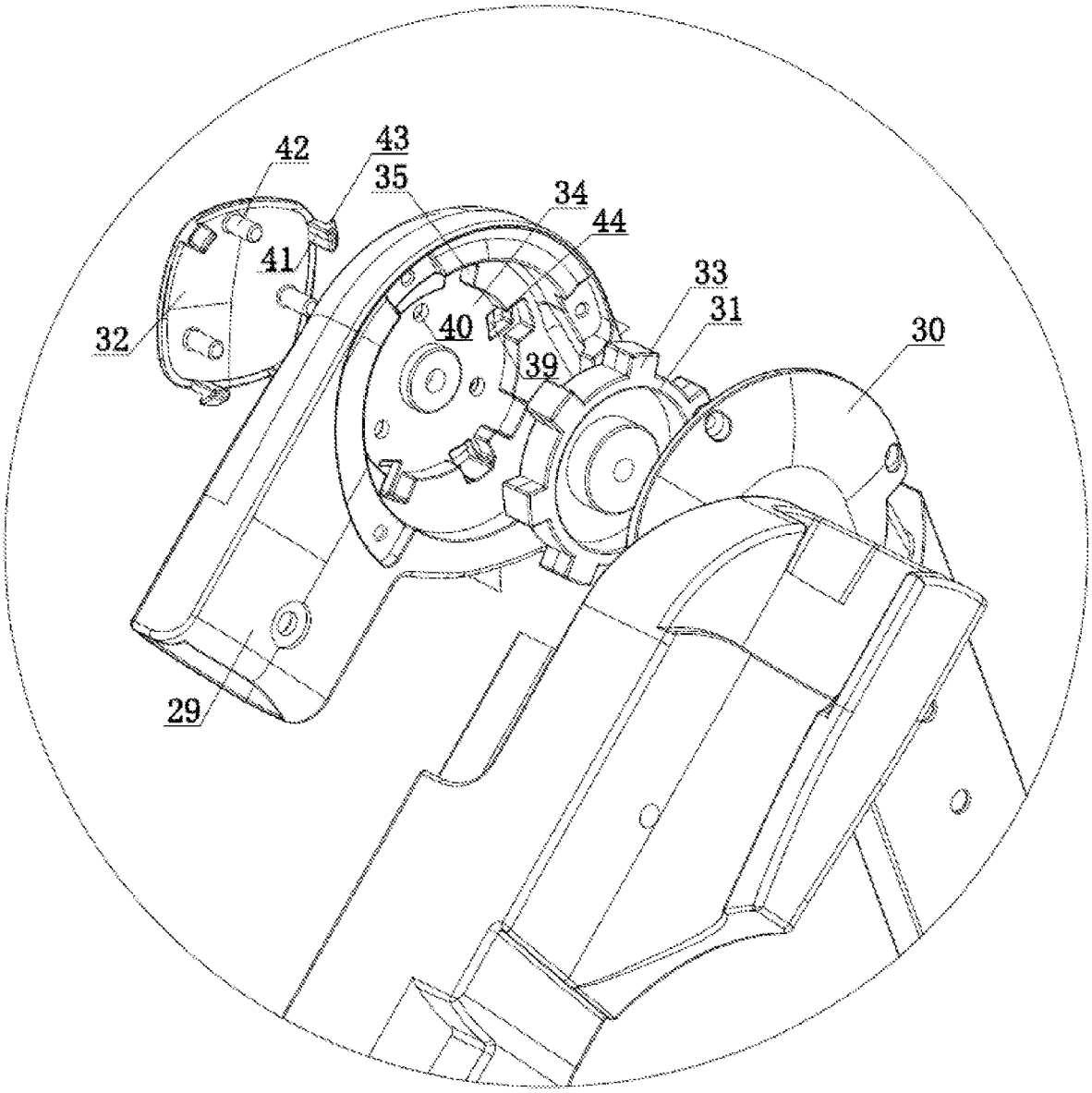
FIG. 5 is an enlarged view of A in FIG. 4.
Figure 6:
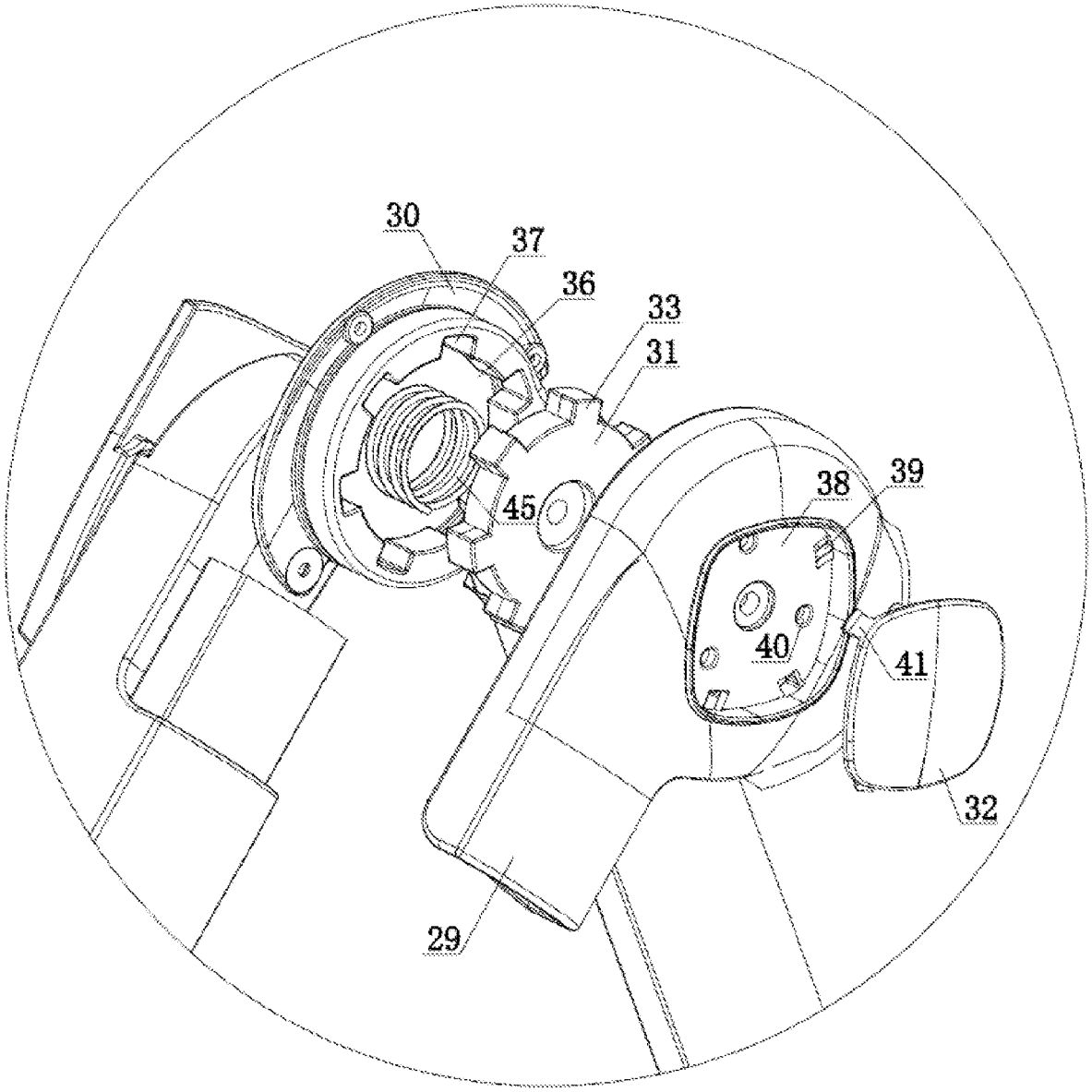
FIG. 6 is an enlarged view of B in FIG. 4.
Figure 7:
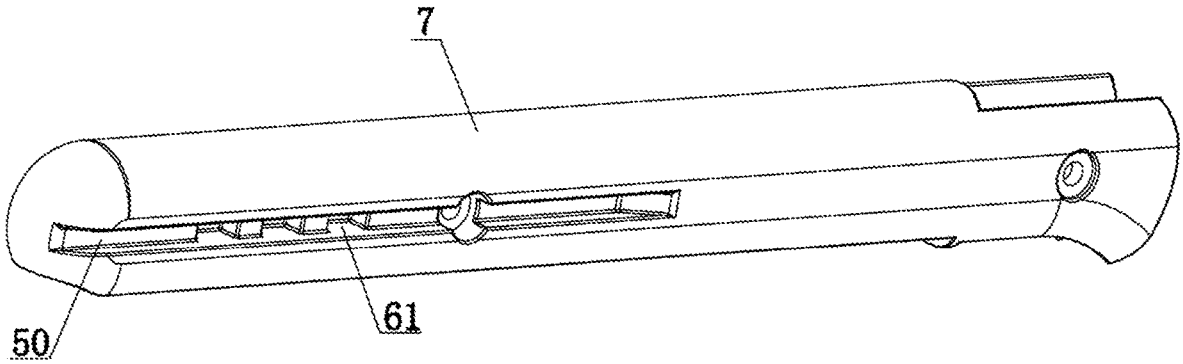
FIG. 7 is a structural view of a left armrest according to the present invention.
Figure 8:
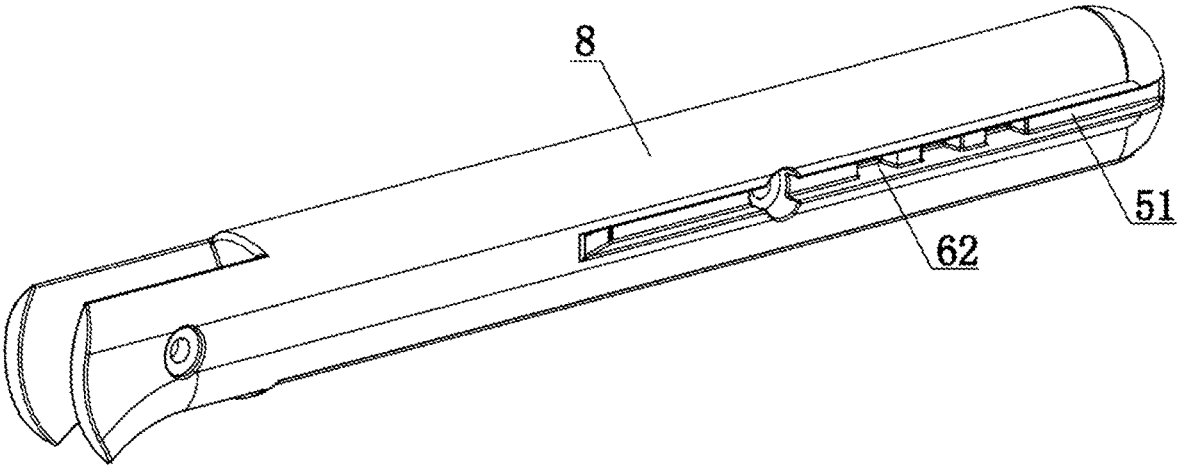
FIG. 8 is a structural view of a right armrest according to the present invention.

Referring to FIGS. 1 to 3, each of the left sleeve member 3 and the right sleeve member 4 is provided with a limiting groove 16 with an open front end. A first insert 17 is provided in the limiting groove 16. A head portion 18 is provided at an inner end of the first insert 17, and a first insert portion 19 is provided at an outer end of the first insert 17. A height of the head portion 18 is greater than a height of the first insert 17. The head portion 18 is provided with a first upper inclined surface 20 and a first lower inclined surface 21. Each of front ends of the left sleeve member 3 and the right sleeve member 4 is provided with a first button 22. A rear end of the first button 22 is provided with an upper pressing plate 23 and a lower pressing plate 24. Inner side surfaces of the upper pressing plate 23 and the lower pressing plate 24 are respectively provided with a second upper inclined surface 25 and a second lower inclined surface 26. The first insert 17 is located between the upper pressing plate 23 and the lower pressing plate 24. The second upper inclined surface 25 and the second lower inclined surface 26 are attached to the first upper inclined surface 20 and the first lower inclined surface 21 respectively. A first spring 27 is provided between an inner side surface of the head portion 18 and an inner side wall of the corresponding left sleeve member 3 and right sleeve member 4. Each of inner side surfaces of the two vertical parts of the front support frame 1 is provided with a plurality of insertion holes 28 spaced apart from top to bottom. The first insert portion 19 passes through the limiting groove 16 to be inserted into a corresponding insertion hole 28.

Referring to FIGS. 1 to 3, when the heights of the left armrest connecting rod 5, the right armrest connecting rod 6, the left armrest 7, the right armrest 8, the dining tray 9, the seat 12 and the backrest 14 need to be adjusted, the first buttons 22 on the left sleeve member 3 and the right sleeve member 4 are pressed. The second upper inclined surface 25 and the second lower inclined surface 26 are attached to the first upper inclined surface 20 and the first lower inclined surface 21 respectively. Therefore, when the first buttons 22 are pressed, the first insert 17 moves insides, such that the first insert portion 19 is separated from the original matching insertion hole 28. At this time, the left sleeve member 3 and the right sleeve member 4 are movable up and down. When the left sleeve member 3 and the right sleeve member 4 are adjusted to desired positions, the first buttons 22 are released, and the first insert portion 19 is inserted into a new insertion hole 28, thereby fixing the left sleeve member 3 and the right sleeve member 4.

Referring to FIGS. 1, 4, 5 and 6, each of top left and right ends of the front support frame 1 is provided with a front pivoting piece 29, and each of top left and right ends of the rear support frame 2 is provided with a rear pivoting piece 30. The front pivoting piece 29 is correspondingly hinged to the rear pivoting piece 30 to form a first movement space. An engaging member 31 movable in left and right directions is provided in the first movement space. The engaging member 31 is engaged with the front pivoting piece 29 and the rear pivoting piece 30. One side surface of the front pivoting piece 29 is provided with a second button 32 for driving the engaging member 31 to move.

Referring to FIGS. 1, 4, 5 and 6, a plurality of engaging teeth 33 are provided on a periphery of the engaging member 31. The other side surface of the front pivoting piece 29 is provided with a first accommodating groove 34 and a plurality of first engaging grooves 35 distributed on a periphery of the first accommodating groove 34. the plurality of first engaging grooves 35 communicate with the first accommodating groove 34. A side surface of the rear pivoting piece 30 is provided with a second accommodating groove 36 and a plurality of second engaging grooves 37 distributed on a periphery of the second accommodating groove 36. the plurality of second engaging grooves 37 communicate with the second accommodating groove 36.

The first accommodating groove 34 and the second accommodating groove 36 form the first movement space. the plurality of engaging teeth 33 are adapted to the plurality of first engaging grooves 35 and the plurality of second engaging grooves 37. In a use state, the plurality of engaging teeth 33 are simultaneously engaged with the plurality of first engaging grooves 35 and the plurality of second engaging grooves 37.

Referring to FIGS. 1, 4, 5 and 6, an outer side surface of the front pivoting piece 29 is provided with a button groove 38 adapted to the second button 32. The button groove 38 is provided with a plurality of first through grooves 39 and a plurality of second through grooves 40 communicating with the first accommodating groove 34. An inner side surface of the second button 32 is provided with a plurality of pressing pieces 41 and a plurality of abutting rods 42. Each pressing piece 41 corresponds to one first through groove 39, and each abutting rod 42 corresponds to one second through groove 40. A hook portion 43 is provided at one end of each pressing piece 41. Each of the first through grooves 39 is provided with an abutting edge portion 44. Each pressing piece 41 passes through a corresponding first through groove 39, and the hook portion 43 abuts against the abutting edge portion 44. Each abutting rod 42 passes through a corresponding second through groove 40. One end of each abutting rod 42 abuts against the engaging member 31. A second spring 45 is provided between the engaging member 31 and the second accommodating groove 36.

Referring to FIGS. 1, 4, 5 and 6, when the front support frame 1 and the rear support frame 2 need to be folded, the second buttons 32 on the front pivoting pieces 29 at the top left and right ends of the front support frame 1 are pressed. When the second buttons 32 are pressed, the engaging members 31 are driven to move, such that the engaging teeth 33 of the engaging member 31 are separated from the first engaging grooves 35. At this time, the front pivoting pieces 29 can be folded relative to the rear pivoting pieces 30, such that the front support frame 1 and the rear support frame 2 are folded.

Referring to FIGS. 1, 7, 8, 9 and 10, a left connecting member 46 and a right connecting member 47 are provided at a bottom of the dining tray 9. Outer side surfaces of the left connecting member 46 and the right connecting member 47 are respectively provided with a left guide bar 48 and a right guide bar 49. Inner side surfaces of the left armrest 7 and the right armrest 8 are respectively provided with a left guide groove 50 and a right guide groove 51. The left guide bar 48 and the right guide bar 49 are respectively located in the left guide groove 50 and the right guide groove 51. A left accommodating groove 52 and a right accommodating groove 53 are respectively provided in the left connecting member 46 and the right connecting member 47. A left insert 54 and a right insert 55 are respectively provided in the left accommodating groove 52 and the right accommodating groove 53. A pull plate 56 is provided at the bottom of the dining tray 9. The pull plate 56 is provided with a left pull bar 57 and a right pull bar 58. One end of the left pull bar 57 passes through the left connecting member 46 to be connected to one end of the left insert 54, and one end of the right pull bar 58 passes through the right connecting member 47 to be connected to one end of the right insert 55. The other end of the left insert 54 and the other end of the right insert 55 are respectively provided with a left insert portion 59 and a right insert portion 60. A plurality of left insertion ports 61 and a plurality of right insertion ports 62 are respectively provided in the left guide groove 50 and the right guide groove 51. The plurality of left insertion ports 61 are spaced apart from front to rear, and the plurality of right insertion ports 62 are spaced apart from front to rear. The left insert portion 59 and the right insert portion 60 are respectively inserted into a corresponding left insertion port 61 and a corresponding right insertion port 62. A left pull bar groove 63 and a right pull bar groove 64 are provided at the bottom of the dining tray 9. The left pull bar 57 and the right pull bar 58 are respectively located in the left pull bar groove 63 and the right pull bar groove 64. Bottoms of the left pull bar groove 63 and the right pull bar groove 64 are respectively provided with a left support plate 65 configured to support the left pull bar 57 and a right support plate 66 configured to support the right pull bar 58.

Figure 9:
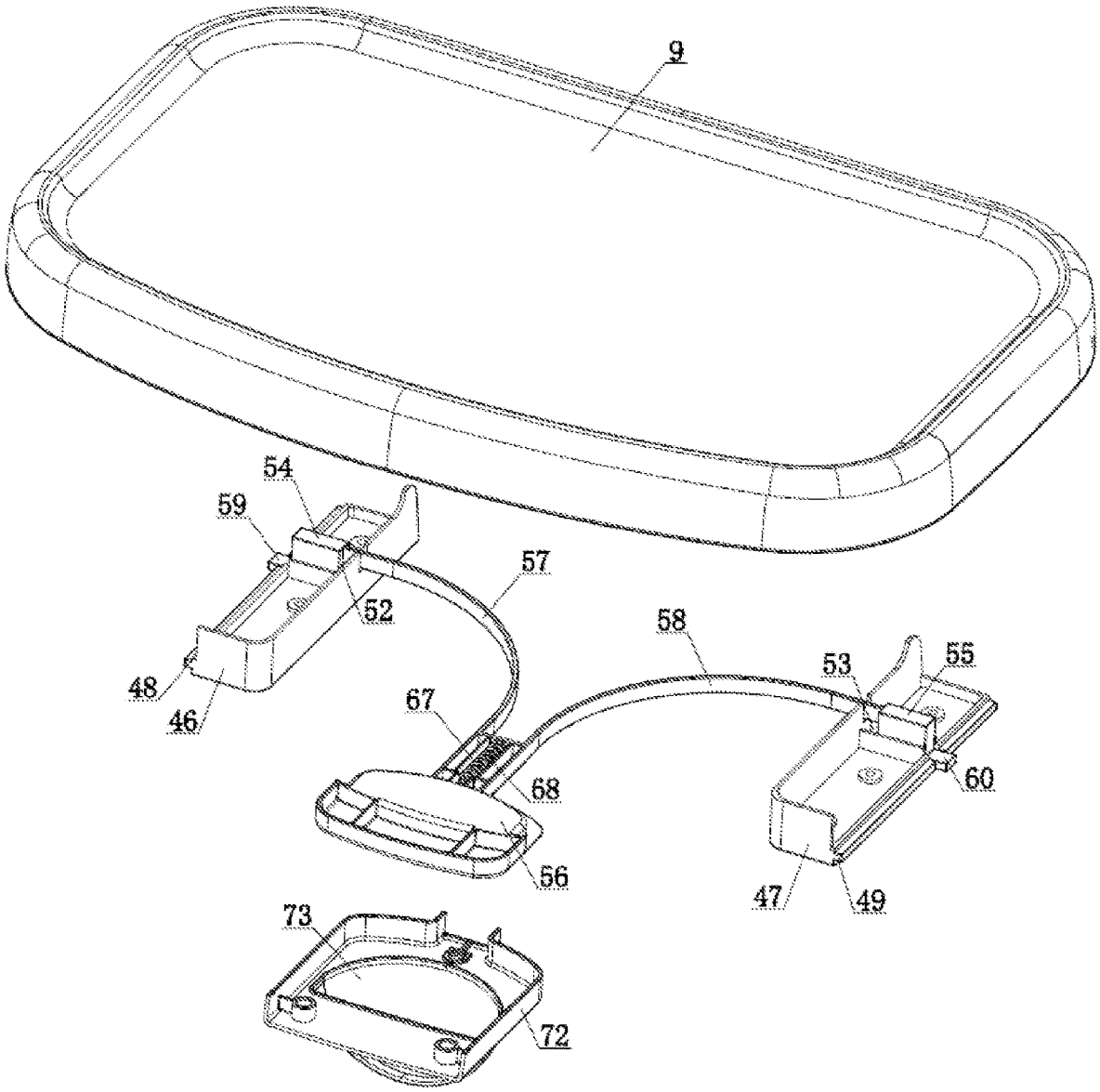
FIG. 9 is an exploded view of the dining tray according to the present invention.
Figure 10:
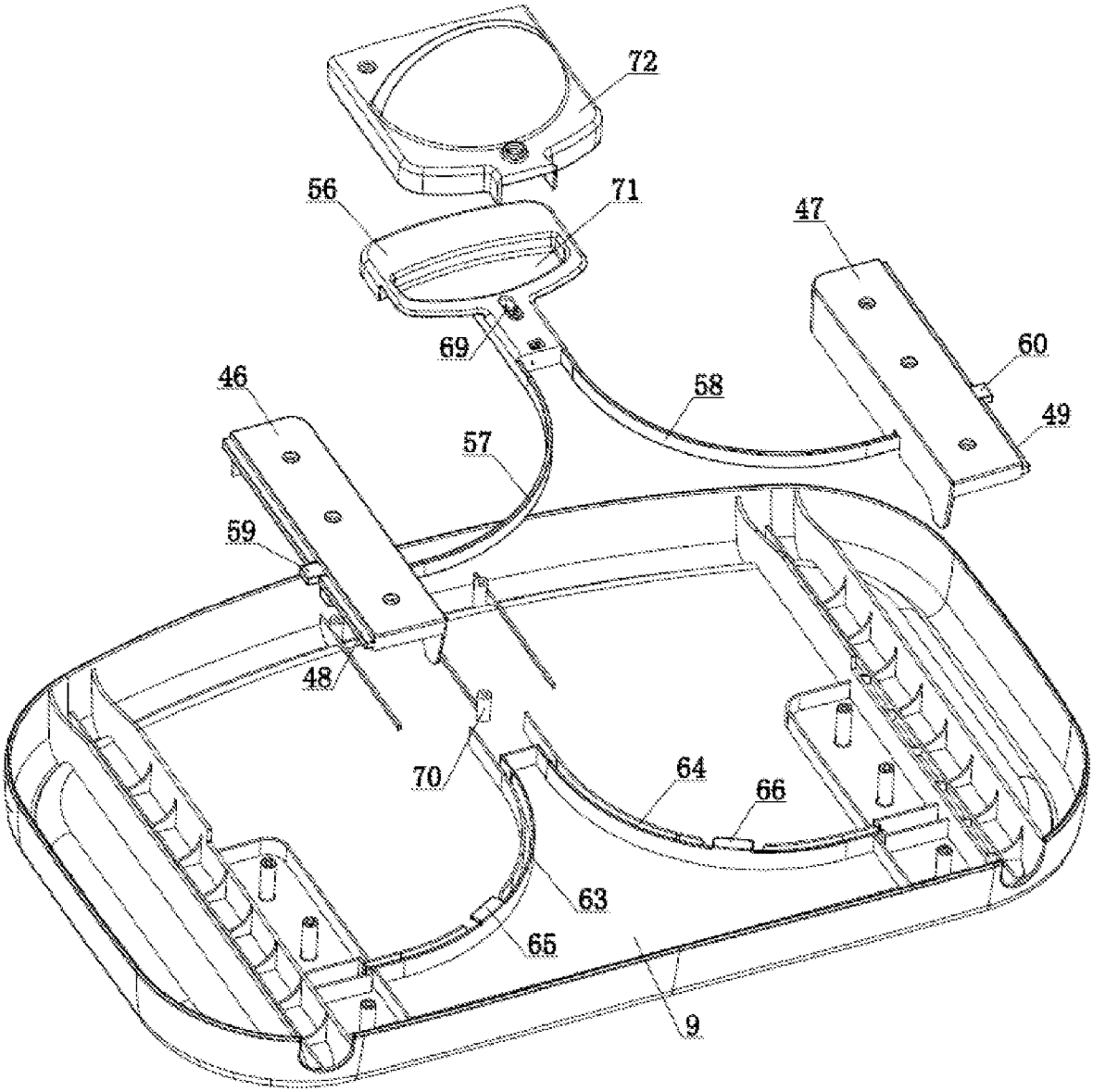
FIG. 10 is an exploded view of the dining tray from another angle according to the present invention.

Referring to FIGS. 9 and 10, a rear top surface of the pull plate 56 is provided with a first spring groove 67. A third spring 68 is provided in the first spring groove 67. A front bottom surface of the first spring groove 67 is provided with a first elongated groove 69. The bottom of the dining tray 9 is provided with a locking post 70. A bottom of the pull plate 56 is provided with a hand accommodating groove 71. The bottom of the dining tray 9 is provided with a bottom plate 72. The bottom plate 72 is provided with a hand accommodating chamber 73 with an open top surface. The hand accommodating chamber 73 is opposite to the hand accommodating groove 71. The locking post 70 passes through the first elongated groove 69 to be locked to the bottom plate 72. The third spring 68 is located between the locking post 70 and a rear inner side wall of the first spring groove 67.

Referring to FIGS. 1, 7, 8, 9 and 10, when the position of the dining tray 9 needs to be adjusted forwards and backwards, the pull plate 56 is pulled forward. The pull plate 56 pulls the left insert 54 and the right insert 55 to move inwardly through the left pull bar 57 and the right pull bar 58 respectively, such that the left insert portion 59 and the right insert portion 60 are separated from the original left insertion port 61 and the right insertion port 62 respectively. In this way, the forward and backward movement of the dining tray 9 is realized. When the dining tray 9 is moved to a desired position, the pull plate 56 is released to allow the left insert portion 59 and the right insert portion 60 to be inserted into a new left insertion port 61 and a new right insertion port 62 respectively, thereby fixing the dining tray 9.

Figure 14:
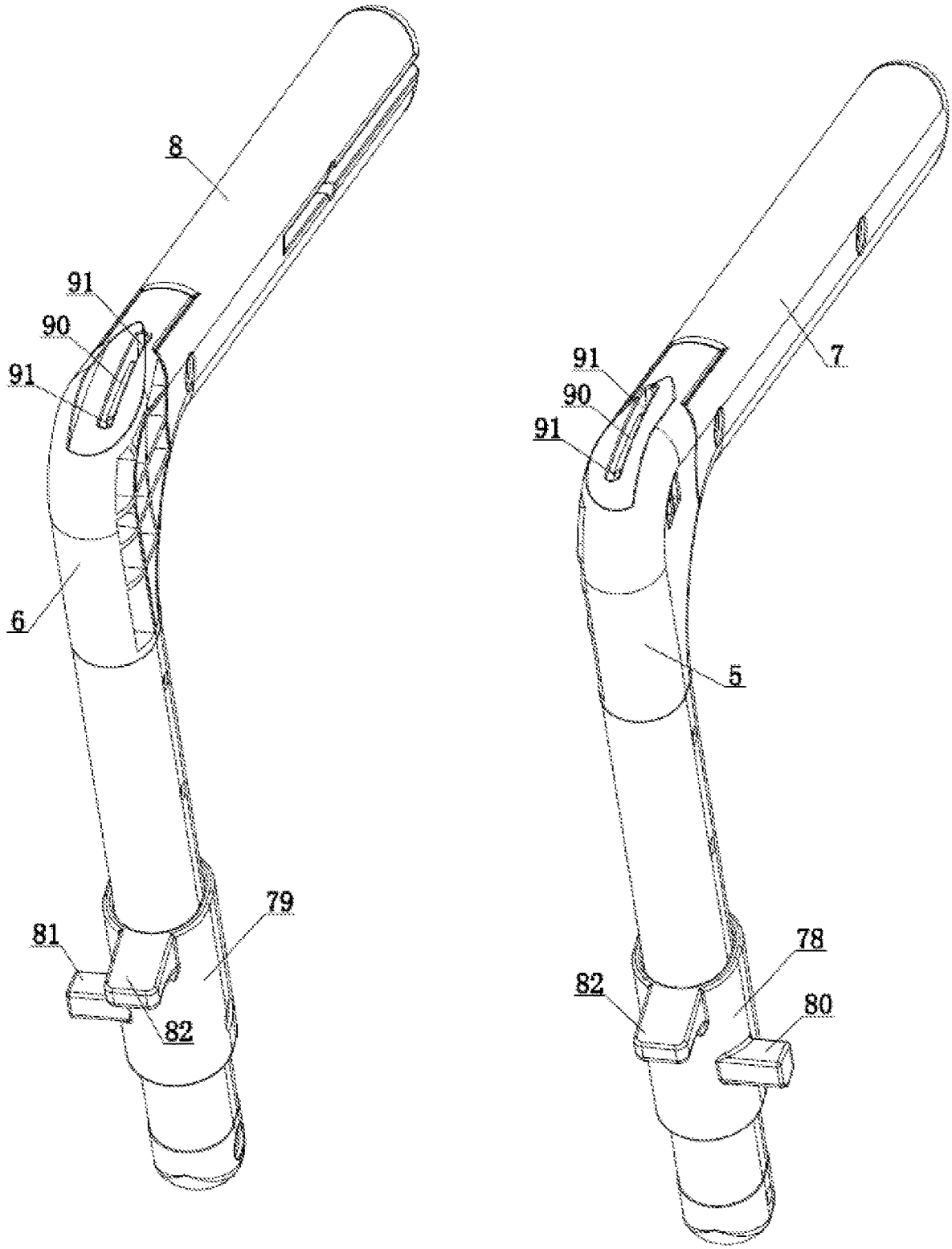
FIG. 14 is a structural view of a left armrest connecting rod and a right armrest connecting rod that are respectively connected to a left sleeve connecting portion and a right sleeve connecting portion according to the present invention.

Referring to FIGS. 1, 2 and 14, the inner side surfaces of the left sleeve member 3 and the right sleeve member 4 are respectively provided with a left sleeve connecting portion 74 and a right sleeve connecting portion 75. Tops of the left sleeve connecting portion 74 and the right sleeve connecting portion 75 are respectively provided with a left insertion groove 76 and a right insertion groove 77. The left sleeve connecting portion 74 and the right sleeve connecting portion 75 are respectively provided with a left sleeve 78 and a right sleeve 79. The left sleeve 78 and the right sleeve 79 are respectively provided with a second insert portion 80 inserted into the left insertion groove 76 and a third insert portion 81 inserted into the right insertion groove 77. Each of top rear ends of the left sleeve 78 and the right sleeve 79 is provided with a pull portion 82. Lower parts of the left armrest connecting rod 5 and the right armrest connecting rod 6 are respectively nested in and connected to the left sleeve 78 and the right sleeve 79.

Referring to FIGS. 1, 2 and 14, when the pull portions 82 on the left sleeve 78 and the right sleeve 79 are lifted upward, the second insert portion 80 and the third insert portion 81 are separated from the left insertion groove 76 and the right insertion groove 77 respectively. The backrest 14 is pushed backward, and the left strut 10 and the right strut 11 are rotated. Thus, the left armrest connecting rod 5, the right armrest connecting rod 6, the left armrest 7, the right armrest 8, the dining tray 9, the seat 12 and the backrest 14 can be rotated synchronously for folding. Meanwhile, when the support rod 15 is detached from the left armrest connecting rod 5 and the right armrest connecting rod 6, the backrest 14 can be further folded.

Referring to FIGS. 1, 11, 12, 13 and 14, an upper rear end surface of the backrest 14 is provided with a second spring groove 83 and two second elongated grooves 84. The second spring groove 83 is located between the two second elongated grooves 84. A fourth spring 85 is provided in the second spring groove 83. A lifting member 86 is provided on an upper rear end portion of the backrest 14. A front end of the lifting member 86 is open. A spring abutting portion 87 and two limiting rods 88 are provided in the lifting member 86. A bottom of the fourth spring 85 abuts against the spring abutting portion 87. The two limiting rods 88 respectively pass through the corresponding second elongated grooves 84 and may be movably connected from top to bottom to the backrest 14 by screws. A front upper portion of the lifting member 86 is provided with rod grooves 89. The support rod 15 has an inverted "U" shape. A middle of the support rod 15 is located in the rod grooves 89. Each of top surfaces of the left armrest connecting rod 5 and the right armrest connecting rod 6 is provided with a sliding groove 90. Two rod holes 91 are arranged from front to rear in the sliding groove 90. Two bottom ends of the support rod 15 are respectively inserted into the rod holes 91 of the left armrest connecting rod 5 and the right armrest connecting rod 6.

Referring to FIGS. 1, 11, 12, 13 and 14, the position of the backrest 14 is adjustable forwards and backwards. When the lifting member 86 is lifted upward, the support rod 15 is lifted upward accordingly, such that the two bottom ends of the support rod 15 are separated from the originally matched rod holes 91. In this way, the backrest 14 can be pushed forward or backward. After the lifting member 86 is released, the two bottom ends of the support rod 15 are inserted into new rod holes 91.

Referring to FIG. 1, the connection between the footrest 13 and the seat 12 can be referred to the prior art, and will not be repeated here.

The above described are merely specific implementations of the present invention, but the design concept of the present invention is not limited thereto. Any non-substantial changes made to the present invention based on the concept of the present invention should fall within the protection scope of the present invention.

What is claimed is:

1. A multifunctional foldable highchair, comprising a front support frame and a rear support frame, wherein the front support frame and the rear support frame are arranged in a foldable manner, and the front support frame and the rear support frame are in a "U" shape; two vertical parts of the front support frame are respectively provided with a left sleeve member and a right sleeve member; the left sleeve member and the right sleeve member are height-adjustable; an inner side surface of the left sleeve member and an inner side surface of the right sleeve member are respectively provided with a left armrest connecting rod and a right armrest connecting rod, wherein the left armrest connecting rod and the right armrest connecting rod are removably attached to the left sleeve member and the right sleeve member; a top front end of the left armrest connecting rod and a top front end of the right armrest connecting rod are respectively provided with a left armrest and a right armrest; a dining tray with a position adjustable from front to rear is provided between the left armrest and the right armrest; a bottom of the left armrest and a bottom of the right armrest are respectively provided with a left strut and a right strut; a top of the left strut and a top of the right strut are connected to the bottom of the left armrest and the bottom of the right armrest respectively; a bottom of the left strut and a bottom of the right strut are hinged to the left sleeve member and the right sleeve member respectively; a seat is supported by a middle of the left strut and a middle of the right strut; a front end of the seat is provided with an angle-adjustable footrest; a rear end of the seat is provided with a backrest, wherein the backrest is hinged to the rear end of the seat; and a rear end surface of the backrest is provided with a support rod, wherein the support rod is detachably connected to the left armrest connecting rod and the right armrest connecting rod.

2. The multifunctional foldable highchair according to claim 1, wherein each of the left sleeve member and the right sleeve member is provided with a limiting groove with an open front end; a first insert is provided in the limiting groove; a head portion is provided at an inner end of the first insert, and a first insert portion is provided at an outer end of the first insert; a height of the head portion is greater than a height of the first insert; the head portion is provided with a first upper inclined surface and a first lower inclined surface; each of a front end of the left sleeve member and a front end of the right sleeve member is provided with a first button; a rear end of the first button is provided with an upper pressing plate and a lower pressing plate; an inner side surface of the upper pressing plate and an inner side surface of the lower pressing plate are respectively provided with a second upper inclined surface and a second lower inclined surface; the first insert is located between the upper pressing plate and the lower pressing plate; the second upper inclined surface and the second lower inclined surface are attached to the first upper inclined surface and the first lower inclined surface respectively; a first spring is provided between an inner side surface of the head portion and an inner side wall of each of the left sleeve member and the right sleeve member; each of inner side surfaces of the two vertical parts of the front support frame is provided with a plurality of insertion holes spaced apart from top to bottom; and the first insert portion passes through the limiting groove to be inserted into a corresponding insertion hole.

3. The multifunctional foldable highchair according to claim 1, wherein each of a top left end and a top right end of the front support frame is provided with a front pivoting piece, and each of a top left end and a top right end of the rear support frame is provided with a rear pivoting piece; the front pivoting piece is correspondingly hinged to the rear pivoting piece to form a first movement space; an engaging member movable in left and right directions is provided in the first movement space; the engaging member is engaged with the front pivoting piece and the rear pivoting piece; and a first side surface of the front pivoting piece is provided with a second button for driving the engaging member to move.

4. The multifunctional foldable highchair according to claim 3, wherein a plurality of engaging teeth are provided on a periphery of the engaging member; a second side surface of the front pivoting piece is provided with a first accommodating groove and a plurality of first engaging grooves distributed on a periphery of the first accommodating groove; the plurality of first engaging grooves communicate with the first accommodating groove; a side surface of the rear pivoting piece is provided with a second accommodating groove and a plurality of second engaging grooves distributed on a periphery of the second accommodating groove; the plurality of second engaging grooves communicate with the second accommodating groove; the first accommodating groove and the second accommodating groove form the first movement space; the plurality of engaging teeth are adapted to the plurality of first engaging grooves and the plurality of second engaging grooves; and in a use state, the plurality of engaging teeth are simultaneously engaged with the plurality of first engaging grooves and the plurality of second engaging grooves.

5. The multifunctional foldable highchair according to claim 4, wherein an outer side surface of the front pivoting piece is provided with a button groove adapted to the second button; the button groove is provided with a plurality of first through grooves and a plurality of second through grooves, wherein the plurality of first through grooves and the plurality of second through grooves communicate with the first accommodating groove; an inner side surface of the second button is provided with a plurality of pressing pieces and a plurality of abutting rods; each pressing piece of the plurality of pressing pieces corresponds to one first through groove, and each abutting rod of the plurality of abutting rods corresponds to one second through groove; a hook portion is provided at one end of each pressing piece; each of the first through grooves is provided with an abutting edge portion; each pressing piece passes through a corresponding first through groove, and the hook portion abuts against the abutting edge portion; each abutting rod passes through a corresponding second through groove; one end of each abutting rod abuts against the engaging member; and a second spring is provided between the engaging member and the second accommodating groove.

6. The multifunctional foldable highchair according to claim 1, wherein a left connecting member and a right connecting member are provided at a bottom of the dining tray; an outer side surface of the left connecting member and an outer side surface of the right connecting member are respectively provided with a left guide bar and a right guide bar; an inner side surface of the left armrest and an inner side surface of the right armrest are respectively provided with a left guide groove and a right guide groove; the left guide bar and the right guide bar are respectively located in the left guide groove and the right guide groove; a left accommodating groove and a right accommodating groove are respectively provided in the left connecting member and the right connecting member; a left insert and a right insert are respectively provided in the left accommodating groove and the right accommodating groove; a pull plate is provided at the bottom of the dining tray; the pull plate is provided with a left pull bar and a right pull bar; one end of the left pull bar passes through the left connecting member to be connected to a first end of the left insert, and one end of the right pull bar passes through the right connecting member to be connected to a first end of the right insert; a second end of the left insert and a second end of the right insert are respectively provided with a left insert portion and a right insert portion; a plurality of left insertion ports and a plurality of right insertion ports are respectively provided in the left guide groove and the right guide groove; the plurality of left insertion ports are spaced apart from front to rear, and the plurality of right insertion ports are spaced apart from front to rear; the left insert portion and the right insert portion are respectively inserted into a corresponding left insertion port and a corresponding right insertion port; a left pull bar groove and a right pull bar groove are provided at the bottom of the dining tray; the left pull bar and the right pull bar are respectively located in the left pull bar groove and the right pull bar groove; and a bottom of the left pull bar groove is provided with a left support plate configured to support the left pull bar, and a bottom of the right pull bar groove is provided with a right support plate configured to support the right pull bar.

7. The multifunctional foldable highchair according to claim 6, wherein a rear top surface of the pull plate is provided with a first spring groove; a third spring is provided in the first spring groove; a front bottom surface of the first spring groove is provided with a first elongated groove; the bottom of the dining tray is provided with a locking post; a bottom of the pull plate is provided with a hand accommodating groove; the bottom of the dining tray is provided with a bottom plate; the bottom plate is provided with a hand accommodating chamber with an open top surface; the hand accommodating chamber is opposite to the hand accommodating groove; the locking post passes through the first elongated groove to be locked to the bottom plate; and the third spring is located between the locking post and a rear inner side wall of the first spring groove.

8. The multifunctional foldable highchair according to claim 1, wherein the inner side surface of the left sleeve member and the inner side surface of the right sleeve member are respectively provided with a left sleeve connecting portion and a right sleeve connecting portion; a top of the left sleeve connecting portion and a top of the right sleeve connecting portion are respectively provided with a left insertion groove and a right insertion groove; the left sleeve connecting portion and the right sleeve connecting portion are respectively provided with a left sleeve and a right sleeve; the left sleeve is provided with a second insert portion inserted into the left insertion groove, and the right sleeve is provided with a third insert portion inserted into the right insertion groove; each of a top rear end of the left sleeve and a top rear end of the right sleeve is provided with a pull portion; and a lower part of the left armrest connecting rod and a lower part of the right armrest connecting rod are respectively nested in and connected to the left sleeve and the right sleeve.

9. The multifunctional foldable highchair according to claim 1, wherein an upper rear end surface of the backrest is provided with a second spring groove and two second elongated grooves; the second spring groove is located between the two second elongated grooves; a fourth spring is provided in the second spring groove; a lifting member is provided on an upper rear end portion of the backrest; a front end of the lifting member is open; a spring abutting portion and two limiting rods are provided in the lifting member; a bottom of the fourth spring abuts against the spring abutting portion; the two limiting rods respectively pass through the two second elongated grooves, and the two limiting rods are movably connected from top to bottom to the backrest by screws; a front upper portion of the lifting member is provided with rod grooves; the support rod has an inverted "U" shape; a middle of the support rod is located in the rod grooves; each of a top surface of the left armrest connecting rod and a top surface of the right armrest connecting rod is provided with a sliding groove; two rod holes are arranged from front to rear in the sliding groove; and two bottom ends of the support rod are respectively inserted into a rod hole of the left armrest connecting rod and a rod hole of the right armrest connecting rod.

* * * * *